US008998711B2

(12) United States Patent
Langille et al.

(10) Patent No.: US 8,998,711 B2
(45) Date of Patent: Apr. 7, 2015

(54) METHOD OF GAMING AND A GAMING SYSTEM

(75) Inventors: Jamie Keith Langille, Las Vegas, NV (US); Jon McNair Leupp, Henderson, NV (US); Patrick Aaron Finch, Las Vegas, NV (US)

(73) Assignee: Aristocrat Technologies Australia Pty Limited (AU)

( * ) Notice: Subject to any disclaimer, the term of this patent is extended or adjusted under 35 U.S.C. 154(b) by 1339 days.

(21) Appl. No.: 12/200,707

(22) Filed: Aug. 28, 2008

(65) Prior Publication Data

US 2009/0061994 A1 Mar. 5, 2009

Related U.S. Application Data

(60) Provisional application No. 60/968,769, filed on Aug. 29, 2007.

(51) Int. Cl.
*A63F 9/24* (2006.01)
*G07F 17/32* (2006.01)

(52) U.S. Cl.
CPC ..... *G07F 17/3267* (2013.01); *G07F 17/32* (2013.01)

(58) Field of Classification Search
CPC G07F 17/3262; G07F 17/326; G07F 17/3267
USPC ..... 463/16, 25, 30, 31
See application file for complete search history.

(56) References Cited

U.S. PATENT DOCUMENTS

| | | | | |
|---|---|---|---|---|
| 5,423,556 | A | 6/1995 | Latypov | |
| 5,984,779 | A | 11/1999 | Bridgeman | |
| 6,012,982 | A | 1/2000 | Piechowiak | |
| 6,168,523 | B1 | 1/2001 | Piechowiak | |
| 2003/0040351 | A1 | 2/2003 | Colin et al. | |
| 2004/0082374 | A1* | 4/2004 | Maya et al. | 463/16 |
| 2004/0102240 | A1 | 5/2004 | Gauselmann | |
| 2004/0142742 | A1* | 7/2004 | Schneider et al. | 463/25 |
| 2004/0198488 | A1 | 10/2004 | Kaminkow et al. | |
| 2005/0026685 | A1 | 2/2005 | Ruark | |
| 2005/0027721 | A1 | 2/2005 | Saenz | |
| 2005/0143159 | A1 | 6/2005 | Kaminkow et al. | |
| 2005/0181855 | A1 | 8/2005 | Englman et al. | |
| 2005/0181873 | A1 | 8/2005 | Bond | |
| 2005/0181874 | A1 | 8/2005 | Bond | |
| 2005/0202864 | A1 | 9/2005 | Duhamel et al. | |
| 2005/0288092 | A1 | 12/2005 | Ellis | |

(Continued)

FOREIGN PATENT DOCUMENTS

| | | |
|---|---|---|
| CA | 2514075 | 12/2005 |
| CA | 2504324 | 10/2006 |
| CA | 2506141 | 11/2006 |
| GB | 2417874 | 3/2006 |

(Continued)

*Primary Examiner* — Paul A D'Agostino
(74) *Attorney, Agent, or Firm* — McAndrews, Held & Malloy, Ltd.

(57) ABSTRACT

A method of gaming comprising: awarding a feature game in response to a trigger event occurring; and conducting a feature game comprising: displaying a plurality of objects for selection; receiving player selections of a plurality of objects, making one or more awards to the player based on the player selected objects; forming a composite image based on the player selected objects; and displaying the composite image on a display.

54 Claims, 8 Drawing Sheets

(56) References Cited

U.S. PATENT DOCUMENTS

| | | | |
|---|---|---|---|
| 2006/0073874 | A1 | 4/2006 | Cregan et al. |
| 2006/0100011 | A1 | 5/2006 | Morrow et al. |
| 2006/0170162 | A1 | 8/2006 | Kumar |
| 2006/0189369 | A1 | 8/2006 | Taylor |
| 2006/0240891 | A1 | 10/2006 | Klinkhammer |
| 2006/0247012 | A1 | 11/2006 | Jorasch |
| 2007/0010310 | A1 | 1/2007 | Goossens |

FOREIGN PATENT DOCUMENTS

| | | |
|---|---|---|
| WO | 9815928 | 4/1998 |
| WO | 2004024266 | 3/2004 |
| WO | 2005025693 | 3/2005 |
| WO | 2006036703 | 4/2006 |
| WO | 2006110747 | 10/2006 |
| WO | 2007067217 | 6/2007 |

* cited by examiner

METHOD OF GAMING AND A GAMING SYSTEM

RELATED APPLICATIONS

The present application is a non-provisional application, which claims priority to U.S. Provisional Patent Application No. 60/968,769 filed Aug. 29, 2007, which is incorporated herein by reference in its entirety.

BACKGROUND OF THE INVENTION

1. Field

The present invention relates to a method of gaming, a game controller, and a gaming system which provide a feature game.

2. Background

Gaming machines such as slot machines may have a feature game that is triggered in response to a condition occurring during the normal game. For example, in response to a particular symbol combination occurring or the player reaching a designated level of the game.

Such features are often designed to provide entertainment to the player while awarding one or more prizes. The present invention aims to provide such a feature.

BRIEF SUMMARY OF THE INVENTION

Summary of the Invention

In a first broad aspect, the invention provides a method of gaming comprising:

- awarding a feature game in response to a trigger event occurring; and
- conducting a feature game comprising:
  - displaying a plurality of objects for selection;
  - receiving player selections of a plurality of objects,
  - making one or more awards to the player based on the player selected objects;
  - forming a composite image based on the player selected objects; and
- displaying the composite image on a display.

In an embodiment, the method comprises displaying objects for selection in a selection area and displaying the composite image in a building area at least while the composite image is being formed, the building area displayed concurrently with the selection area.

In an embodiment, the method comprises displaying a plurality of selectable objects as a plurality of subsets of objects and receiving a player selection from at least two subsets.

In an embodiment, the method comprises receiving a player selection of one object from each subset.

In an embodiment, the method comprises displaying the subsets in a series of successive screens.

In an embodiment, the step of forming is performed in accordance with at least one building rule.

In an embodiment, at least one building rule specifies a relative location of an object in said composite image.

In an embodiment, forming said composite image comprises employing at least one base image.

In an embodiment, the method comprises updating the display of the composite image after each object selection.

In an embodiment, the method comprises making an award for each player selection.

In an embodiment, the method comprises making an award based on the composite image.

In an embodiment, the method comprises awarding at least one prize to the player.

In an embodiment, there are a plurality of awards and at least one award modifies another award.

In an embodiment, the awards are selected from a set of awards, one of which may result in a player not receiving a prize.

In an embodiment, the method comprises forming a plurality of composite images.

In a second broad aspect, the invention provides a gaming system comprising:

- at least one display;
- a player input mechanism; and
- a game controller arranged to:
- award a feature game in response to a trigger event occurring; and
- conduct the feature game by:
  - displaying a plurality of objects for selection on the at least one display;
  - receiving player selections of a plurality of objects,
  - making one or more awards to the player based on the player selected objects;
  - forming a composite image based on the player selected objects; and
  - displaying the composite image on the at least one display.

In an embodiment, the game controller is arranged to control the at least one display to display objects for selection in a selection area and display the composite image in a building area at least while the composite image is being formed, the building area displayed concurrently with the selection area.

In an embodiment, the game controller is arranged to control the at least one display to display a plurality of selectable objects as a plurality of subsets of objects and receive a player selection from at least two subsets.

In an embodiment, the game controller is arranged to receive a player selection of one object from each subset.

In an embodiment, the game controller is arranged to control the at least one display to display the subsets in a series of successive screens.

In an embodiment, the game controller forms the composite image in accordance with at least one building rule.

In an embodiment, at least one building rule specifies a relative location of an object in said composite image.

In an embodiment, the game controller forms the composite image by employing at least one base image.

In an embodiment, the game controller is arranged to update the display of the composite image after each object selection.

In an embodiment, the game controller makes an award for each player selection.

In an embodiment, the game controller makes an award based on the composite image.

In an embodiment, the game controller awards at least one prize to the player.

In an embodiment, there are a plurality of awards and at least one award modifies another award.

In an embodiment, the game controller selects awards from a set of awards, one of which results in a player not receiving a prize.

In an embodiment, the game controller is arranged to form a plurality of composite images.

In an embodiment, the game controller comprises a display module arranged to control the at least one display.

In an embodiment, the game controller comprises a selection processing module arranged to process player selections and make awards to the player.

In an embodiment, the game controller comprises a processor and the display module is constituted by the processor executing display program code.

In an embodiment, the game controller comprises a processor and the selection processing module is constituted by the processor executing selection processing program code.

In an embodiment, the gaming system comprises an object data structure storing data defining the selectable objects.

In an embodiment, the object data structure stores data defining the selectable objects as a plurality of subsets of objects.

In an embodiment, the object data structure stores data defining awards associated with respective ones of the plurality of objects.

In an embodiment, the game controller comprises an outcome generator module.

In an embodiment, the game controller comprises a processor and the outcome generator module is constituted by the processor executing outcome generation code.

In a third broad aspect, the invention provides a game controller for a gaming system, the game controller arranged to:

award a feature game in response to a trigger event occurring; and conduct the feature game by:

controlling at least one associated display to display a plurality of objects for selection;

receiving player selections of a plurality of objects, making one or more awards to the player based on the player selected objects;

forming a composite image based on the player selected objects; and displaying the composite image on the at least one associated display.

In an embodiment, the game controller is arranged to control the at least one display to display objects for selection in a selection area and display the composite image in a building area at least while the composite image is being formed, the building area displayed concurrently with the selection area.

In an embodiment, the game controller is arranged to control the at least one display to display a plurality of selectable objects as a plurality of subsets of objects and receive a player selection from at least two subsets.

In an embodiment, the game controller is arranged to receive a player selection of one object from each subset.

In an embodiment, the game controller is arranged to control the at least one display to display the subsets in a series of successive screens.

In an embodiment, the game controller is arranged to form the composite image in accordance with at least one building rule.

In an embodiment, at least one building rule specifies a relative location of an object in said composite image.

In an embodiment, the game controller is arranged to form the composite image by employing at least one base image.

In an embodiment, the game controller is arranged to update the display of the composite image after each object selection.

In an embodiment, the game controller is arranged to make an award for each player selection.

In an embodiment, the game controller is arranged to make an award based on the composite image.

In an embodiment, the game controller is arranged to award at least one prize to the player.

In an embodiment, there are a plurality of awards and at least one award modifies another award.

In an embodiment, the game controller is arranged to select awards from a set of awards, one of which results in a player not receiving a prize.

In an embodiment, the game controller is arranged to form a plurality of composite images.

In an embodiment, the game controller is constituted at least in part, by a processor executing program code.

In a fourth broad aspect, the invention provides a Program code which when executed implements the above method.

In a fifth broad aspect, the invention provides a computer readable medium comprising the above program code.

In a sixth broad aspect, the invention provides a data signal comprising the program code.

In a seventh broad aspect, the invention extends to transmitting the program code.

BRIEF DESCRIPTION OF SEVERAL VIEWS OF THE DRAWINGS

Brief Description of the Drawings

Figure 1:
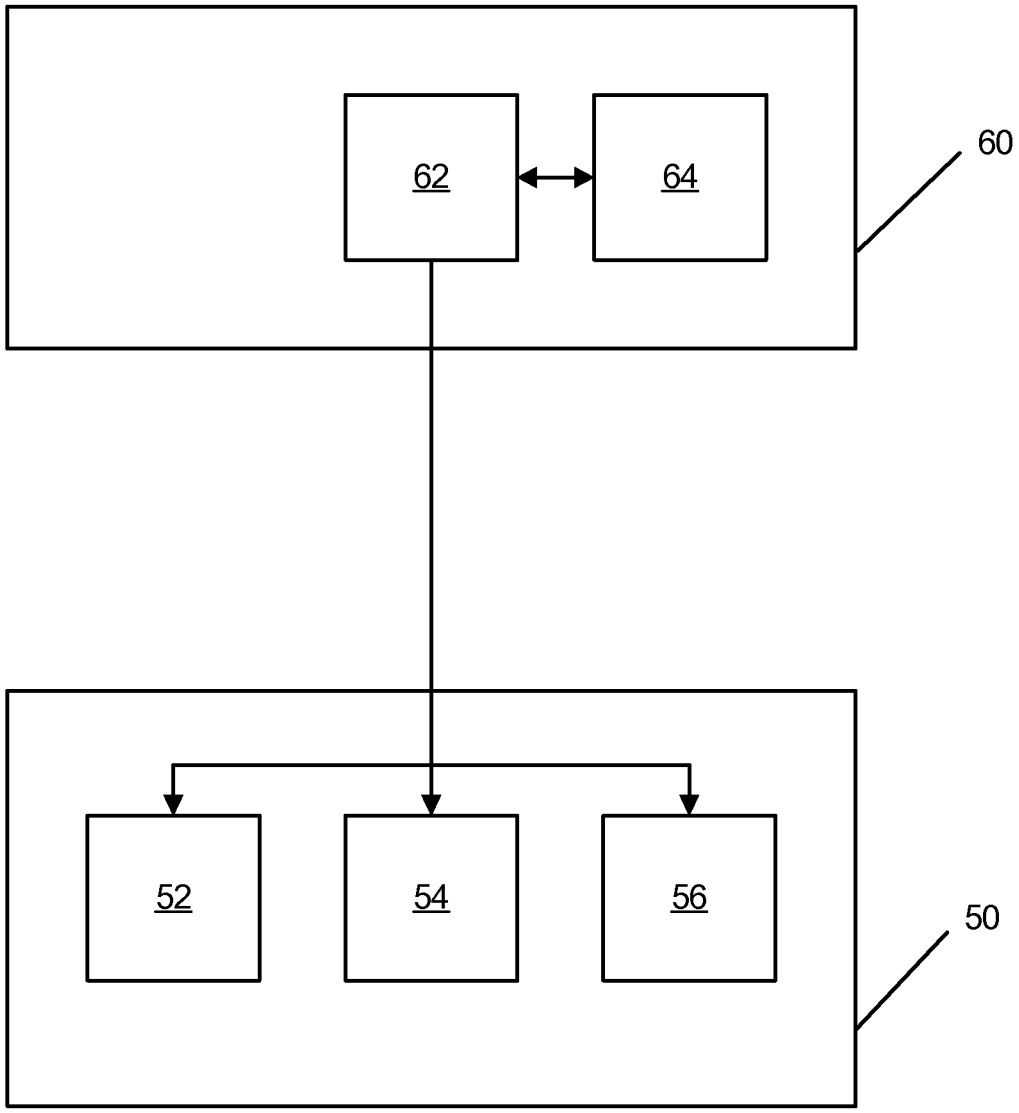
Figure 2:
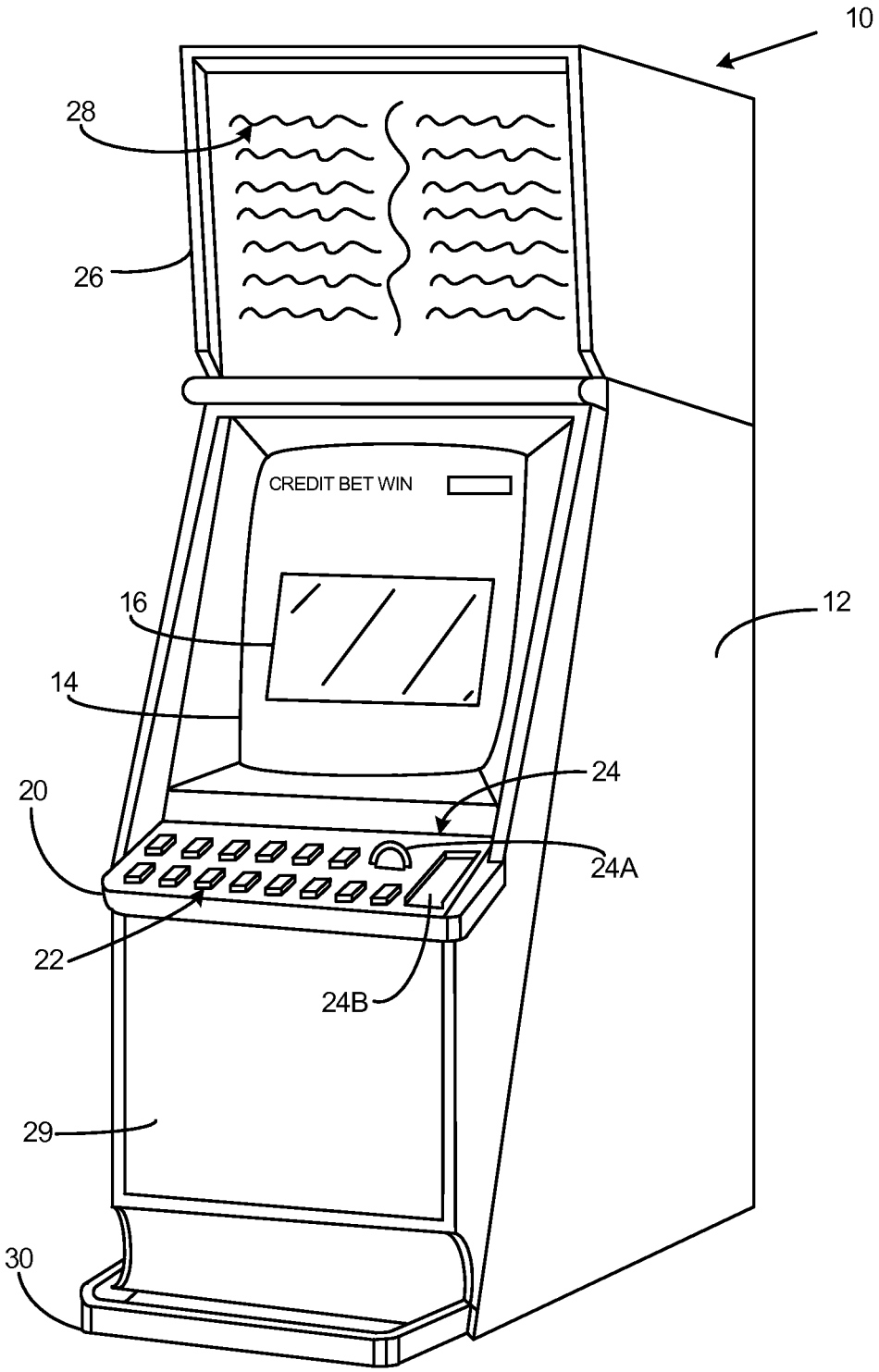
Figure 3:
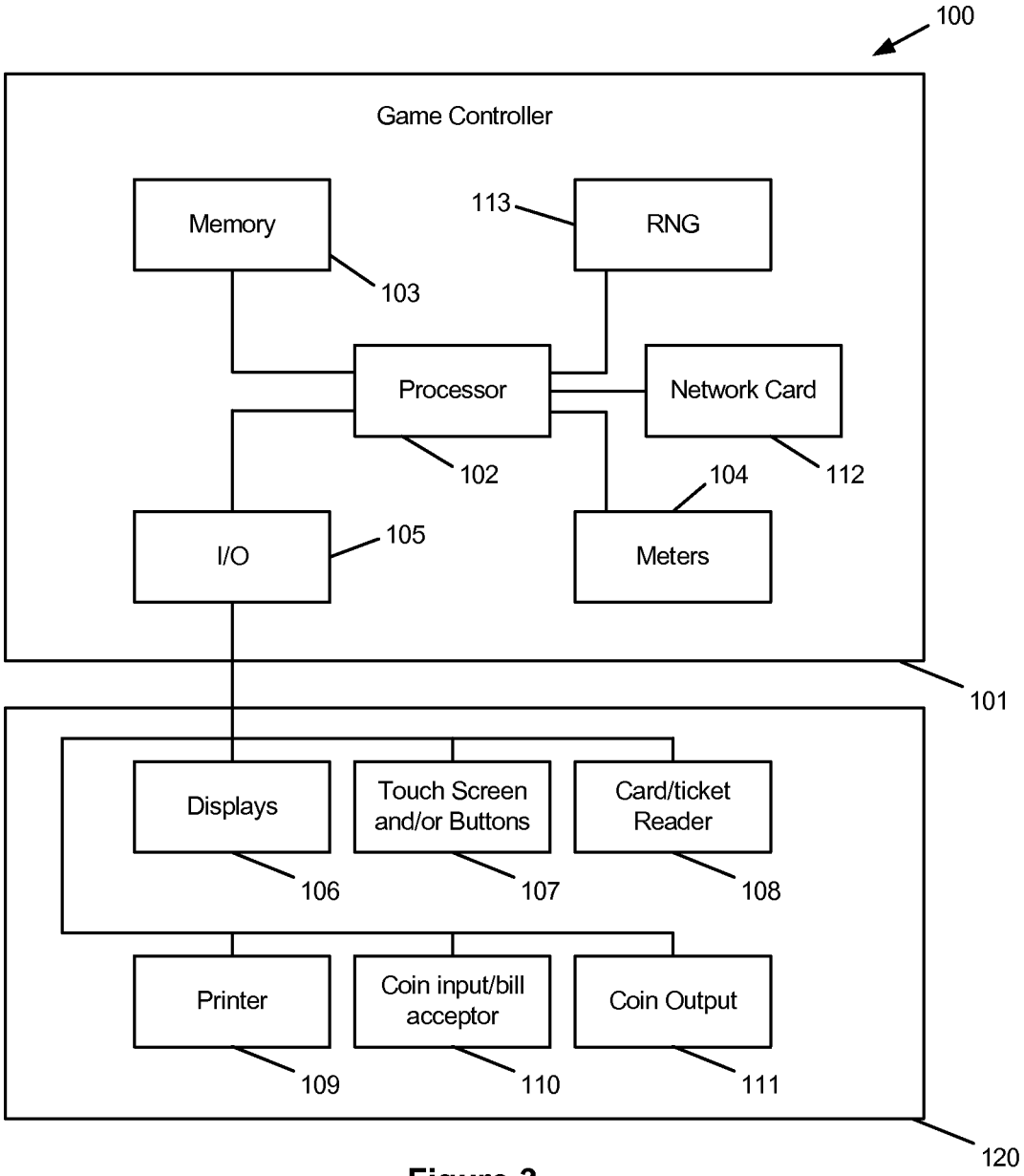
Figure 4:
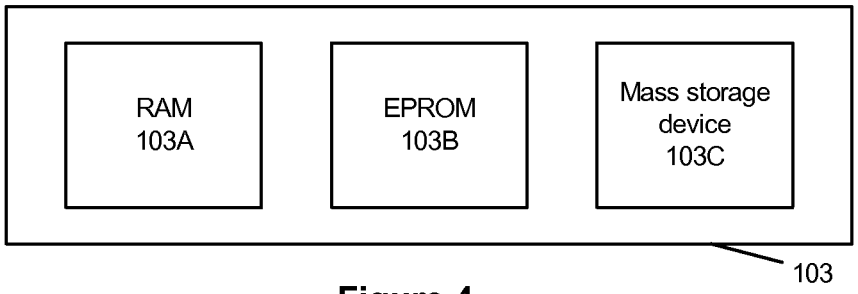
Figure 5:
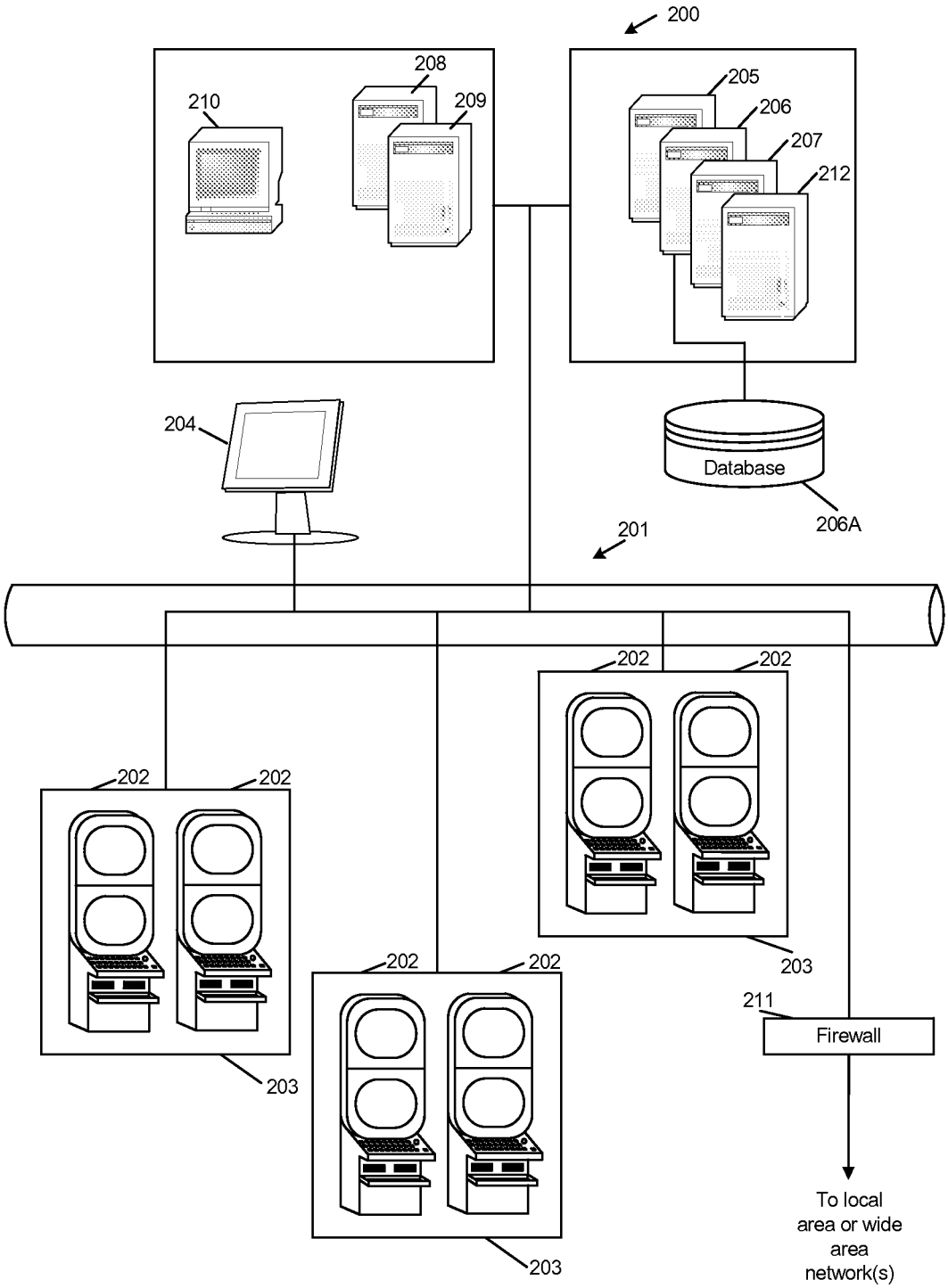
Figure 6:
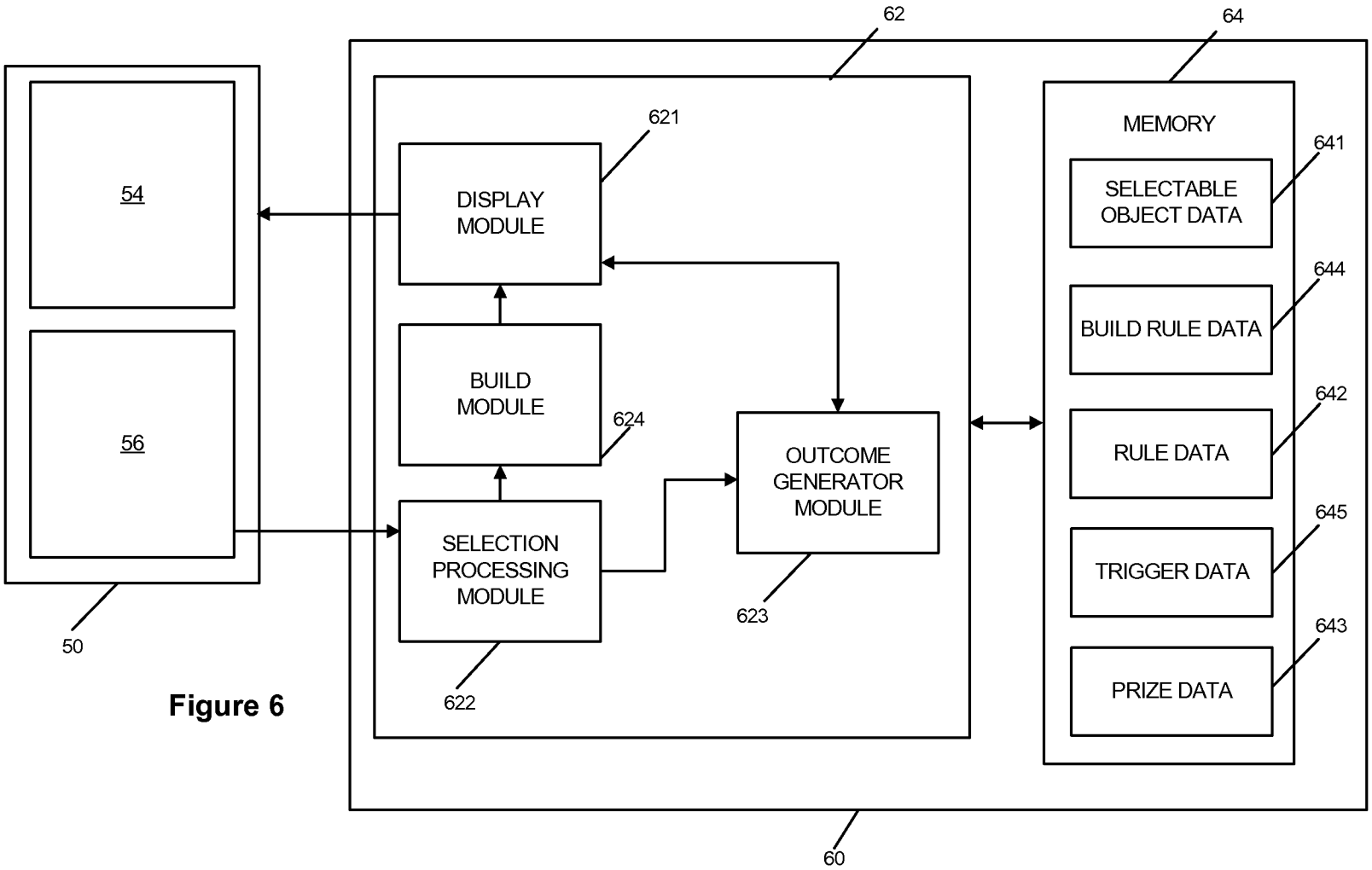

Exemplary embodiments of the invention will now be described in relation to the following drawings in which:

FIG. 1 is a block diagram of the components of a gaming system;

FIG. 2 is a perspective view of a gaming machine;

FIG. 3 is a block diagram of the functional components of a gaming machine;

FIG. 4 is a block diagram representing the structure of a memory;

FIG. 5 is a schematic diagram of a networked gaming system;

FIG. 6 is a further block diagram of a gaming system.

Figure 7:
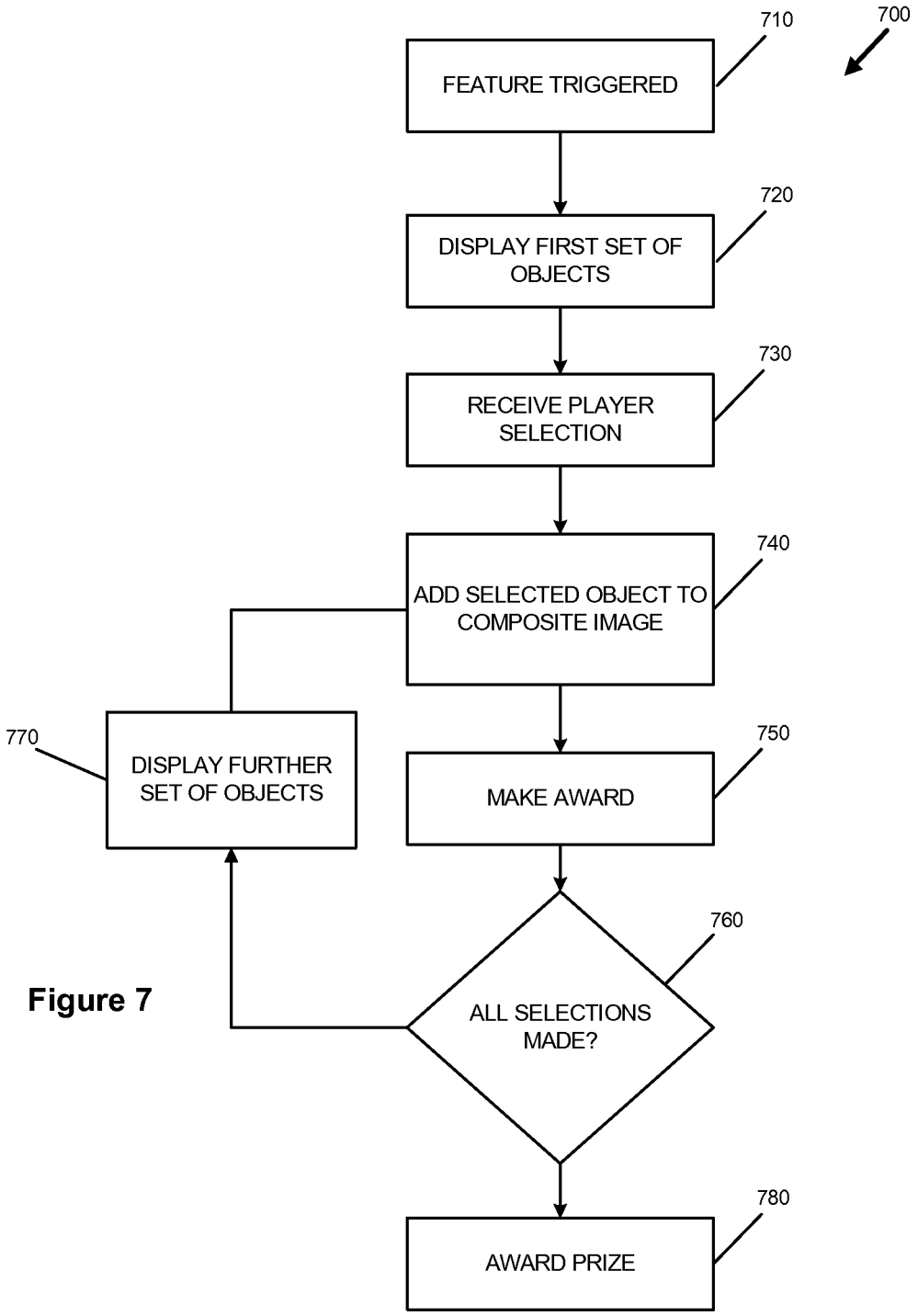

FIG. 7 is a flowchart of an embodiment of the invention; and

Figure 8:
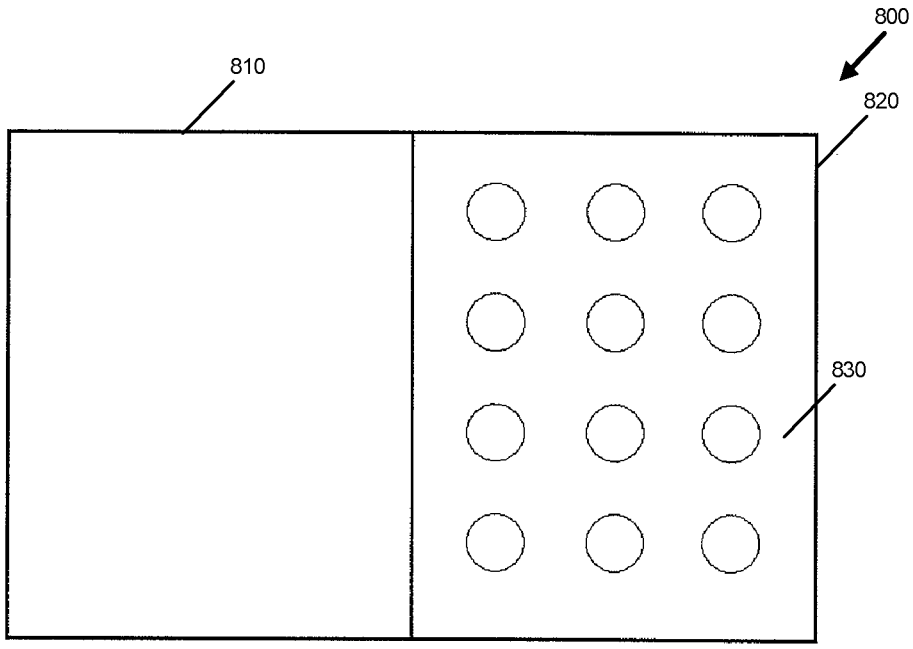
Figure 9:
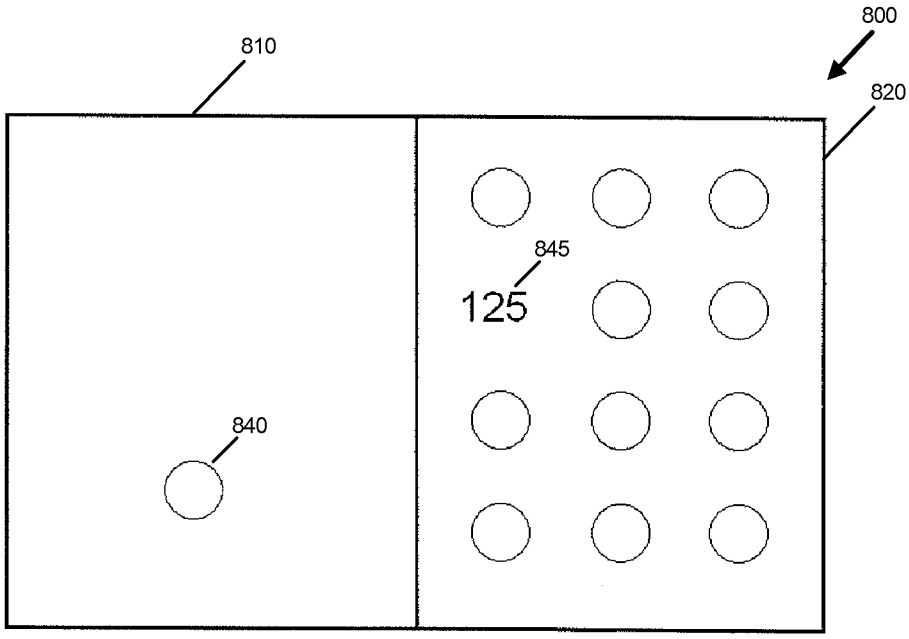
Figure 10:
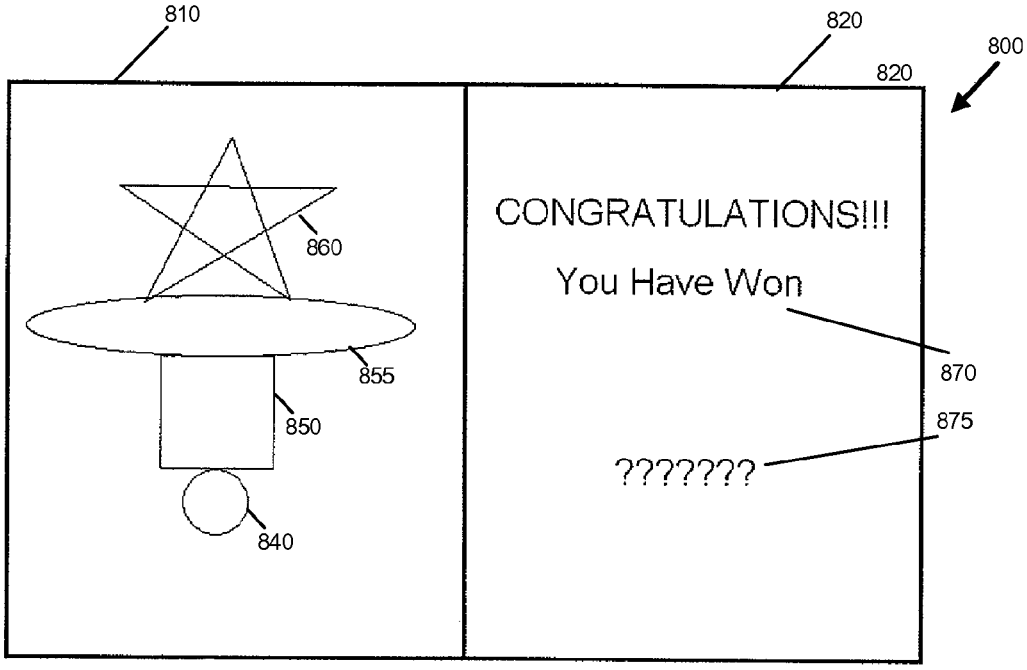

FIGS. 8 to 10 are exemplary displays of an example.

DETAILED DESCRIPTION OF THE INVENTION

Detailed Description

Referring to the drawings, there is shown a gaming system arranged to permit a player to form a composite image. In an embodiment, the composite image is formed in a build area on the display by making selections of a plurality of objects displayed in a selection area on the display.

In a first form, a stand alone gaming machine is provided wherein all or most components required for implementing the game are present in a player operable gaming machine.

In a second form, a distributed processing architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

The gaming system has several components. At the broadest level, the components include a player interface 50 and a game controller 60 as illustrated in FIG. 1. The player interface 50 is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts such as a cash or bill validator, credit or debit card reader or the like. The credit mechanism may also include electronic fund transfer device such as described in U.S. Pat. No. 6,511,377 the disclosure of which is hereby incorporated by reference.

The components also includes one or more displays 54 such as an LCD, CRT or other type of electronic video display. Also provided is a player input mechanism 56 such as a button panel or a touch screen device at a display 54 that enables a player to input game play instructions, such as desired play lines, bet amounts and player choices during the play of the game.

The game controller 60 is in data communication with the player interface 50 and typically includes a processor 62 that receives and processes the player inputs, such as game play instructions in accordance with game play rules and outputs game play outcome data and/or graphics to the display 54. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

A gaming system in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during game play, and acts as the player input mechanism. The mid-trim 20 also houses a credit input mechanism 24 which in this example includes a coin input chute 24A and a bill validator 24B. Other credit input mechanisms may also be employed, for example, a card reader for reading a smart card, debit card or credit card or devices and mechanisms for electronic transfer of funds. A reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit. Displays of the embodiment may be fitted with a touch screen. The top box 26 may also include a display, for example a video display unit, which may be of the same type as the display 14, or of a different type and may have touch screen functionality as well.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102 to ultimately select and display random outcomes for the game at the display 106. Persons skilled in the art will appreciate that the reference to random numbers includes pseudo-random numbers.

In the example shown in FIG. 3, a player interface 120 includes peripheral devices that communicate with the game controller 101 comprising one or more displays 106, a touch screen and/or buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to carry out accounting functions in respect of the Jackpot game and control display 204 to show the jackpot amounts. A player loyalty system server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network. A loyalty system 212 is also connected to the network.

The gaming network 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games as required by the terminals.

The gaming system of FIG. 1 is shown in more detail in FIG. 6, from which it can be seen that the game controller 60 implements a plurality of modules including a display module 621 which controls a display 54 to display a selection area. In the embodiment, the display module controls the display 54 within the selection area to display at least one player selectable object on the basis of selectable object data 641. The player selects an object from the displayed set of objects by operating the player input mechanism 56 such as a touch screen. A selection processing module 622 is arranged to receive instructions from the output of the player input mechanism 56 and process the instructions to determine which object has been selected.

Selection processing module 622 provides data describing the selected object to the build module 624 which applies build rules 644 to determine what should be added to the composite image. In the case, where the selected objects are images represented in their entirety within the composite image, the build rules may specify a location for the selectable object in a build area of the display and passes relevant data to the display module 621 to control the display 54 to display the selected object at the new location.

In the embodiment, once an object has been selected, the display 54 is updated so that the selection area displays another set of objects from which a selection can be made. In this way a series of selections can be made from a series of subsets of objects displayed on successive screens.

In an alternative embodiment, the objects displayed in the display area do not correspond directly to what is ultimately displayed in the composite object but rather provide an intermediate display is made that is representative of the image that will be displayed. For example the object may be an icon that represents the image. For example, the images used to build the composite image may be three-dimensional but a player may select them by selecting two-dimensional icons associated with the objects. In another example, the object may be a complete image of the component of the composite image but part or all of the image may be obscured once assembled in the composite image. By way of specific example, where the composite image is a car and a player selects an engine to added to the car, the engine itself may not be visible in the composite object but the composite image may be updated to indicate that the car is now "moving" by displaying exhaust smoke. In another example, an object may show an image in a first orientation in the selection area but in a second orientation once added to the composite image or once another object is added. For example, a cowboy may be displayed in a standing position in an initial composite image but displayed in a riding position once a horse is added to the composite image.

During subsequent selections the build module 624 determines in accordance with the build rules specified by the build rule data 644 the subsequent composition of the composite image displayed in a build area of the display 54. In one example, once the composite image is completed it may be animated or animated if a condition is met such as sufficient objects being selected. In one example, once the image is completed the building and selection areas disappear and the composite image is displayed over the entirety of the display. In another example, the selection and building areas are on separate displays.

In addition to the composite image being built on the display under control of the build module 624 and the display module 621, awards are made to the player outcome generator module. Typically, the game is implemented as a feature where awards are made to the player for each selection. Awards may be in any of the forms known in the art for example, a credit amount, a fixed prize, a multiplier, a combination of a prize and multiplier, free games, a combination of prizes and free games, etc. In some embodiments, awards will have an effect on other awards, for example a multiplier. In some examples, an award made for selecting one object will cancel out other awards, for example if the last award is a "zero times" multiplier or a feature game terminating symbol. At the end of the object selections, the outcome generator module 623 determines based on the awards what prize to be awarded to the player and the prize is output by display module 621 to display 54. Credit meters and/or free game meters are updated to reflect the award(s).

As indicated above, this game will typically be implemented as a feature game. Accordingly, outcome generator module 623 is also arranged to conduct a base game and to trigger the game feature based on a trigger condition 645. The trigger condition may be any known trigger event in the art, for example, a symbol combination, a series of related winning instances, an amount spent, an ante-bet, a randomly selected event, a trigger from an intervening feature game or the like.

The process of the embodiment is shown in FIG. 7. The process 700 involves a feature being triggered 710 and a first set of selection objects being displayed 720. A player selection is received 730. The selected object is added to the composite image 740 and an award is made to the player 750. At step 760 it is determined whether all selections have been made or whether a selection termination event has occurred such as, for example, the player selecting a feature terminating object. If all selections have not been made then a further set of objects is displayed 770 and a further selection received 730. The process continues until all selections have been made or a feature terminating condition occurs at which time a prize is awarded should this be appropriate.

Further aspects of the method will be apparent from the above description of the gaming system. Persons skilled in the art will also appreciate that the method could be embodied in program code. The program code could be supplied in a number of ways, for example on a computer readable medium, such as a disc or a memory (for example, that could replace part of memory 103) or as a data signal (for example, by downloading it from a server).

A person skilled in the art will appreciate that a number of variations may be made to the above invention. For example, it is described above that the objects selected by the player are combined to form a composite object. In some embodiments, one or more base objects may be provided to which the user selected objects are added or assembled. Persons skilled in the art will appreciate that where the objects are referred to, these will actually be images of objects displayed on the display.

In other embodiments, all of the objects may be placed in a single selection area concurrently and the player makes plural selections from the selection area. In other embodiments, some of the objects subsets of objects the same. The objects may be themed for example, geometric objects, car parts, parts of anatomy, tools, toys or the like.

In a further variation, the player may be able to select where they place the objects when assembling the object in order to have further control over the object that is built. In these embodiments, the selection processing module 622 is arranged to receive data from the player input mechanism 56 specifying both the object that is selected and the position at which the object is to be located.

As but an example, the composite image being assembled may be an image of a building, an automobile, a landscape or portrait, or other image which is consistent with the theme of the game such that the individual objects selected by the player are components the building, an automobile, a landscape or portrait, or other image.

The game may offer one or more levels of object assembling. For example, if the player selects all of the objects at a first level to assemble an image or representation of a car without selecting a feature terminating symbol, the player may be awarded to advance to a next selection level where he/she picks objects to assemble, for example, a yacht. The player may progress through several levels until a feature terminating object is selected. Alternatively, the player may be awarded in advance a number of selections and the awarded number of selections may determine how many selection levels the player is able to complete. For example, if each selection level includes five object selections, a player awarded twelve selections is able to complete two levels and partly complete a third level.

The feature game may be an offering unique to the underlying game from which it is triggered. Alternatively the feature game may be arranged as a community game offered in a bank of a number of gaming machines. For example, and with reference to FIG. 5, a number such as, for example, ten gaming machines 202 may be linked to provide a common feature game. When one or more gaming machines 202 triggers the feature game, selection objects may be displayed at a common display for the gaming machines 202 or on each or several of the displays 54 of one or more of the gaming machines 202. For example, when the feature game is triggered players participating in the feature game may each have an opportunity to select objects, receive awards and build one or more composite images. Where the players co-operate to build a unified image, player selection creates a team atmosphere and adds to the excitement of the game. Alternatively the players may build competing images from their selections such as race cars, aircraft, yachts or the like which, after the composite images are built compete in a race or other competition.

The building of the composite image, as depicted in FIG. 5, may also be offered as a system wide game. For example when the feature game is triggered by, for example, a random selection, system-wide coin in wagers, a triggering outcome at a gaming machine 202, a prompt from the casino venue or the like, the gaming floor management server 208 may issue a notification to some or all of the players that the feature game has been triggered. Participating players would have a display 54 offer the selection objects and through the player interface 50 players would make their selections. A single composite image or competing composite images may be created and displayed as a result of the selection and award(s) issued. For example, where the game is offered to the entire floor of the casino, each player may be given selections to build an image of the casino. Certain players may be displayed all of the component selection objects to build a complete image and the remaining players having fewer objects than necessary or feature terminating objects which will terminate their game short of completion of a complete object. The objects may be randomly assigned such that the ability to create the require, entire image, occurs infrequently so that large awards may be offered for a player successfully completing the image by selection of all of the required selection objects, e.g. the player makes the selections to assemble objects representing the casino, hotel, pool area and shopping area of the casino.

EXAMPLE

Referring to FIGS. 8 to 10 there is shown an example where the player makes selections of geometric objects from a series of selection screens. FIGS. 8 to 10 illustrate parts of that process. Initially the display 800 shows two split screens comprising a building half 810 which is initially empty and a selecting half 820 which is full of an initial set of selection objects, in this case twelve round objects 830. As shown in FIG. 9 once the player selects one of the round objects 830 and this is moved to the building half where it is displayed as object 840. Concurrently, an award 845 of 125 credits is displayed to the player. FIG. 10 illustrates the process after a player is made a number of selections of a round object 840, square object 850 elliptical object 855 and a star shaped object 860. All the selections are complete and the selecting half 820 now displays an award message 870 congratulating the player on winning and an award amount 875.

While we have shown and described certain embodiments of the present invention it is to be understood that it is subject to many variations without departing from the spirit and scope of the appended claims.

In particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. A method of gaming for use with a gaming system having a display and a controller, the method comprising:

awarding via the controller a feature game in response to a trigger event occurring; and conducting via the controller the feature game comprising:

displaying on the display a plurality of objects for selection such that each object is player-identifiable before the object can be selected;

receiving via the controller player selections of a plurality of the displayed objects, making at least one award based on each object selected;

combining via the controller the objects selected through received selections to thereby form a composite image, the composite image being composed solely of the objects selected;

displaying portions of the composite image as the objects are selected on the display concurrently with the plurality of objects displayed for selection; and competing with the composite image in a competition with another composite image formed by another player.

2. A method as claimed in claim 1, comprising displaying objects for selection in a selection area and displaying the composite image in a building area at least while the composite image is being formed, the building area displayed concurrently with the selection area.

3. A method as claimed in claim 1 comprising displaying a plurality of selectable objects as a plurality of subsets of objects and receiving a player selection from at least two subsets.

4. A method as claimed in claim 3 comprising receiving a player selection of one object from each subset.

5. A method as claimed in claim 3 comprising displaying the subsets in a series of successive screens.

6. A method as claimed in claim 1 wherein the step of forming is performed in accordance with at least one building rule.

7. A method as claimed in claim 5, wherein at least one building rule specifies a relative location of an object in said composite image.

8. A method as claimed in claim 1 wherein forming said composite image comprises employing at least one base image.

9. A method as claimed in claim 1 comprising updating the display of the composite image after each object selection.

10. A method as claimed in claim 1 comprising making an award for each player selection.

11. A method as claimed in claim 1 comprising making an award based on the composite image.

12. A method as claimed in claim 1 comprising awarding at least one prize to the player.

13. A method as claimed in claim 1 wherein there are a plurality of awards and at least one award modifies another award.

14. A method as claimed in claim 1 wherein the awards are selected from a set of awards, one of which may result in a player not receiving a prize.

15. A method as claimed in claim 1 comprising forming a plurality of composite images.

16. A gaming system comprising:

at least one display;

a player input mechanism; and a game controller arranged to:

award a feature game in response to a trigger event occurring; and conduct the feature game by:

displaying a plurality of objects for selection on the at least one display such that each object is identifiable by a player before it can be selected;

receiving player selections of a plurality of objects, making at least one award to the player based on each object selected by the player;

combining the objects selected by the player to thereby form a composite image, the composite image being composed solely of actual objects selected by the player;

displaying portions of the composite image as the objects are selected on the at least one display concurrently with the plurality of objects displayed for selection; and competing with the composite image in a competition with another composite image formed by another player.

17. A gaming system as claimed in claim 16, wherein the game controller is arranged to control the at least one display to display objects for selection in a selection area and display the composite image in a building area at least while the composite image is being formed, the building area displayed concurrently with the selection area.

18. A gaming system as claimed in claim 16, wherein the game controller is arranged to control the at least one display to display a plurality of selectable objects as a plurality of subsets of objects and receive a player selection from at least two subsets.

19. A gaming system as claimed in claim 18, wherein the game controller is arranged to receive a player selection of one object from each subset.

20. A gaming system as claimed in claim 18, wherein the game controller is arranged to control the at least one display to display the subsets in a series of successive screens.

21. A gaming system as claimed in claim 16 wherein the game controller forms the composite image in accordance with at least one building rule.

22. A gaming system as claimed in claim 21, wherein at least one building rule specifies a relative location of an object in said composite image.

23. A gaming system as claimed in claim 16, wherein the game controller forms the composite image by employing at least one base image.

24. A gaming system as claimed in claim 16, wherein the game controller is arranged to update the display of the composite image after each object selection.

25. A gaming system as claimed in claim 16, wherein the game controller makes an award for each player selection.

26. A gaming system as claimed in claim 16, wherein the game controller makes an award based on the composite image.

27. A gaming system as claimed in claim 16, wherein the game controller awards at least one prize to the player.

28. A gaming system as claimed in claim 16, wherein there are a plurality of awards and at least one award modifies another award.

29. A gaming system as claimed in claim 16 wherein the game controller selects awards from a set of awards, one of which results in a player not receiving a prize.

30. A gaming system as claimed in claim 16, wherein the game controller is arranged to form a plurality of composite images.

31. A gaming system as claimed in claim 16 wherein the game controller comprises a display module arranged to control the at least one display.

32. A gaming system as claimed in claim 16 wherein the game controller comprises a selection processing module arranged to process player selections and make awards to the player.

33. A gaming system as claimed in claim 31, and wherein the game controller comprises a processor and the display module is constituted by the processor executing display program code.

34. A gaming system as claimed in claim 32, and wherein the game controller comprises a processor and the selection processing module is constituted by the processor executing selection processing program code.

35. A gaming system as claimed in claim 16 comprising an object data structure storing data defining the selectable objects.

36. A gaming system as claimed in claim 35, and wherein the object data structure stores data defining the selectable objects as a plurality of subsets of objects.

37. A gaming system as claimed in claim 35, and, wherein the object data structure stores data defining awards associated with respective ones of the plurality of objects.

38. A gaming system as claimed in claim 16, wherein the game controller comprises an outcome generator module.

39. A gaming system as claimed in claim 38, wherein the game controller comprises a processor and the outcome generator module is constituted by the processor executing outcome generation code.

40. A game controller for a gaming system, the game controller comprising a processor configured to:

award a feature game in response to a trigger event occurring; and conduct the feature game by:

controlling at least one associated display to display a plurality of objects for selection such that each object is identifiable by a player before it can be selected;

receiving player selections of a plurality of objects;

making at least one award to the player based on each object selected by the player;

combining the objects selected by the player to thereby form a composite image, the composite image being composed solely of the objects selected by the player;

displaying portions of the composite image as the objects are selected on the at least one associated display concurrently with the plurality of objects displayed for selection; and competing with the composite image in a competition with another composite image formed by another player.

41. A game controller as claimed in claim 40, arranged to control the at least one display to display objects for selection in a selection area and display the composite image in a building area at least while the composite image is being formed, the building area displayed concurrently with the selection area.

42. A game controller as claimed in claim 41, arranged to control the at least one display to display a plurality of selectable objects as a plurality of subsets of objects and receive a player selection from at least two subsets.

43. A game controller as claimed in claim 42, arranged to receive a player selection of one object from each subset.

44. A game controller as claimed in claim 43, arranged to control the at least one display to display the subsets in a series of successive screens.

45. A game controller as claimed in claim 40, arranged to form the composite image in accordance with at least one building rule.

46. A game controller as claimed in claim 45, wherein at least one building rule specifies a relative location of an object in said composite image.

47. A game controller as claimed in claim 40, arranged to form the composite image by employing at least one base image.

48. A game controller as claimed in claim 40, arranged to update the display of the composite image after each object selection.

49. A game controller as claimed in claim 40, arranged to make an award for each player selection.

50. A game controller as claimed in claim 40, wherein arranged to make an award based on the composite image.

51. A game controller as claimed in claim 40, arranged to award at least one prize to the player.

52. A game controller as claimed in claim 40, wherein there are a plurality of awards and at least one award modifies another award.

53. A game controller as claimed in claim 40, arranged to select awards from a set of awards, one of which results in a player not receiving a prize.

54. A game controller as claimed in claim 40, arranged to form a plurality of composite images.

* * * * *